US006268450B1

(12) United States Patent
Wade

(10) Patent No.: US 6,268,450 B1
(45) **Date of Patent: *Jul. 31, 2001**

(54) ACRYLIC FIBER POLYMER PRECURSOR AND FIBER

(75) Inventor: Bruce E. Wade, Decatur, AL (US)

(73) Assignee: Solutia Inc., St. Louis, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/075,574

(22) Filed: May 11, 1998

(51) Int. Cl.[7] ..... C08F 130/04

(52) U.S. Cl. ..... 526/240; 526/292.6; 526/329.3; 526/330

(58) Field of Search ..... 526/342, 286, 526/328.5, 334, 240, 292.6, 329.3, 330

(56) References Cited

U.S. PATENT DOCUMENTS

| | | | | |
|---|---|---|---|---|
| 3,193,603 | | 7/1965 | Rowe, Jr. et al. | 264/182 |
| 3,253,880 | | 5/1966 | Lawson, Jr. et al. | 8/115.5 |
| 3,366,711 | | 1/1968 | Mazzolini et al. | 260/898 |
| 3,426,104 | | 2/1969 | Masson | 260/895 |
| 3,507,823 | | 4/1970 | Trapasso et al. | 260/32.6 |
| 3,867,499 | | 2/1975 | Morgan | 264/182 |
| 3,932,577 | | 1/1976 | Palethorpe et al. | 264/182 |
| 4,067,948 | | 1/1978 | Reinehr et al. | 264/182 |
| 4,075,075 | | 2/1978 | Sakurada et al. | 204/159.17 |
| 4,265,970 | | 5/1981 | Bach | 428/364 |
| 4,294,884 | | 10/1981 | Bach et al. | 428/364 |
| 4,297,412 | | 10/1981 | Achard et al. | 428/370 |
| 4,326,051 | * | 4/1982 | Suling et al. | 526/342 |
| 4,364,675 | * | 12/1982 | Frushour | 526/342 |
| 4,384,091 | * | 5/1983 | Korte et al. | 526/342 |
| 4,447,384 | | 5/1984 | Tamura et al. | 264/206 |
| 4,513,126 | * | 4/1985 | Yamazaki et al. | 526/342 |
| 4,577,008 | * | 3/1986 | Benton et al. | 526/342 |
| 4,661,572 | * | 4/1987 | Setsuie et al. | 526/342 |
| 4,764,575 | * | 8/1988 | Highgate et al. | 526/342 |
| 4,873,142 | | 10/1989 | Bach | 428/359 |
| 5,496,510 | | 3/1996 | Capone | 264/182 |

FOREIGN PATENT DOCUMENTS

| | | | | |
|---|---|---|---|---|
| 963989 | | 3/1975 | (CA) | 400/89 |
| 80551 | * | 3/1971 | (DE) | 526/342 |
| 0 181 998 A2 | | 4/1986 | (EP) | 400/89 |
| 695449 | * | 8/1953 | (GB) | 526/342 |
| 1231745 | * | 5/1971 | (GB) | 526/342 |
| 48-63029 | | 9/1973 | (JP) | 400/89 |
| 59-192717 | | 11/1984 | (JP) | 400/89 |
| 63-243318 | | 10/1988 | (JP) . | |
| 8-74119 | | 3/1996 | (JP) . | |

OTHER PUBLICATIONS

Walkenhorst, Dolan® Outdoor for Convertible Car Top Materials, Autotextilien Automotive Textiles, Sep. 17–19, 1997, p. 8–24.

Masson et al., Acrylic fiber technology: A 1984 perspective, Fiber Producer, Jun. 1994, p. 34–42.

Capone, Wet–Spinning Technology, Acrylic Fiber Technology, Acrylic Fiber Technology and Applications, Marcel Dekker Inc., 1995, p. 71–78.

* cited by examiner

*Primary Examiner*—Bernard Lipman
(74) *Attorney, Agent, or Firm*—Howrey Simon Arnold & White, LLP

(57) ABSTRACT

An acrylic fiber comprises an acrylic fiber polymer precursor having acrylonitrile in an amount from 90 to 98.0 wt. % of said fiber and a neutral vinyl monomer in an amount from greater than 0 to 7.0 wt. %, the fiber possessing hot-wet elongation less than 9.0% at 70° C.

14 Claims, No Drawings

ACRYLIC FIBER POLYMER PRECURSOR AND FIBER

FIELD OF THE INVENTION

The present invention relates to an acrylic fiber polymer precursor composition. This invention also relates to an acrylic fiber having improved hot/wet properties and processes of producing such fibers.

BACKGROUND

Various acrylic fiber polymer precursors have been utilized in the production of acrylic fibers for use in outdoor applications, such as in awnings and other outdoor textiles due to certain desirable physical properties (e.g., decay resistance, UV stability weather fastness, etc.). For example, U. S. Pat. No. 4,265,970 describes an acrylic fiber that was utilized in acrylic fabric for outdoor textiles. This fiber is formed from an acrylic fiber polymer precursor having less than 93 wt. % acrylonitrile monomer and 7 wt. % or more vinyl acetate (VA). However, the fabric produced from such fibers possesses inadequate hot-wet properties such as elongation.

Large amounts of vinyl monomers (e.g., above 7 wt. %), have been included in polymer formulations for the purpose of providing the fiber with flame retardency, additional dyesites, or increased hydrophilility. However, vinyl monomer amounts below 7 wt. % have not been utilized due to problems in spinning the resulting polymer. Lower amounts of vinyl monomers have not been used due to solutioning difficulties in dimethylacetamide such as filtration prior to spinning of the solutioned polymer, poor fiber color from elevated solutioning temperatures, and low standard fiber elongation under ambient conditions.

In spite of the desirable physical properties manifested by acrylonitrile containing fibers, there are a number of difficulties encountered during the processing of fabrics made therefrom, and still provide adequate hot-wet properties. Various means have been employed in the art to improve the tensile properties of such fibers under hot-wet conditions. A number of means involve incorporating various chemical agents to modify the structural arrangement of the polymer itself. Several methods have been employed which physically modify the fiber structure. These methods and combinations thereof have met with limited success. During processing of fabrics containing polyacrylonitrile where such fabrics are exposed to heat and water or steam, deformation owing in part to a plasticity of such polyacrylonitrile materials is frequently observed. Furthermore, wrinkling or overstretching when a woven or knitted fabric thereof is subjected to tension is often exhibited. Other desirable properties for outdoor textiles include high abrasion resistance and low lint generation.

Dolan® T-65 is an outdoor textile material manufactured by Courtaulds Fibers, Inc. that is made almost entirely from a polyacrylonitrile (PAN) homopolymer (including less than about 0.8 wt. % methyl acrylate). The Dolan® T-65 acrylic fabric was made in an attempt to improve upon the hot-wet properties of previous acrylic fabrics. However, it is not possible to use a polymer, such as in the Dolan 65, which is nearly a homopolymer in all spinning solvents and provide adequate hot-wet properties. For example, using certain spinning solvents such as dimethylacetamide, to spin acrylic fiber requires a high dissolution temperature of approximately 120° C. or higher. When spinning acrylonitrile under normal residence times in solution at this elevated temperature, white base polymer color in the resulting fiber cannot be achieved.

Accordingly, there is a need for an acrylic fiber polymer precursor composition that may be economically and easily processed into acrylic fiber, which has desirable appearance, and improved hot-wet and abrasion properties.

SUMMARY OF THE INVENTION

The present invention relates to an acrylic fiber polymer precursor composition that is suitable for the economic production of acrylic fiber having desirable appearance, and improved hot-wet and abrasion resistant properties.

An acrylic fiber polymer precursor of the present invention comprises acrylonitrile in an amount from greater than 80 to 98.0 wt. %; neutral vinyl monomer in an amount from greater than 0 to 7.0 wt. %; and optionally, ionic vinyl monomer in an amount from greater than 0 to 3.0 wt. % of the polymer.

An acrylic fiber of the present invention comprises of an acrylic fiber polymer precursor having acrylonitrile in an amount from greater than 80 to 98.0 wt. %; neutral vinyl monomer in an amount from greater than 0 to 7.0 wt. %; and optionally, ionic vinyl monomer in an amount from greater than 0 to 1.0 wt. % of the fiber.

DETAILED DESCRIPTION OF PREFERRED EMBODIMENTS

In an embodiment of the present invention, an acrylic fiber polymer precursor is produced by using continuous free radical redox aqueous dispersion polymerization, in which water is the continuous phase and the initiator is water soluble. The redox system consists of a persulfate (the oxidizing agent and initiator, sometimes called "catalyst"), sulfur dioxide or a bisulfite (reducing agent, sometimes called "activator") and iron (the true redox catalyst). This redox system works at pH 2 to 3.5 where the bisulfite ion predominates and where both the ferric and ferrous ion are sufficiently soluble.

$$S_2O_8^{2-}+Fe^{2+}\rightarrow SO_4^{2-}+SO_4^{*1-}+Fe^{3+}$$

$$HSO_3^{1-}+Fe^{3+}\rightarrow HSO_3^{*}+Fe^{2+}$$

Salts of the initiator and activator may be used such as ammonium, sodium, or potassium. Additionally, a persulfate initiator or an azo initiator may be utilized to generate free radicals for the vinyl polymerization rather than the above-mentioned redox system. In an embodiment of the present invention, the acrylic fiber polymer precursors thus obtained may be used to form acrylic fibers by various methods, including dry and wet spinning such as those set forth in U.S. Pat. Nos. 3,088,188; 3,193,603; 3,253,880; 3,402,235; 3,426,104; 3,507,823; 3,867,499; 3,932,577; 4,067,948; 4,294,884; 4,447,384; 4,873,142; and 5,496,510, the entire subject matter of which is incorporated herein by reference. Preferably, the fibers of the present invention are formed by wet spinning.

For example, acrylic fiber polymer precursors of the present invention may be dissolved in an organic solvent or mixtures of organic solvents, which may contain 0 to 3 wt. % water. The solution may contain 10 to 40 wt. % polymer, preferably, 20 to 30 wt. %, and more preferably 22 to 27 wt. % of the solution. In inorganic solvents, the solution may contain 8 to 15 wt. % polymer and greater than 8 wt. %. The solution may be heated to a temperature of 50–150° C., preferably 70–140° C., and more preferably 80–120° C. to dissolve the polymer.

The solvent in the spin bath is normally the same solvent in which the polymer is dissolved prior to spinning. Water may also be included in the spin bath and generally that portion of the spin bath will comprise the remainder. Suitable organic spinning solvents for the present invention include N,N-dimethylacetamide (DMAc), N,N-dimethylformamide (DMF), dimethylsulfoxide, and ethylene carbonate. Suitable inorganic solvents include aqueous sodium thiocyanate. Preferably, the solvent utilized in the spinning process of the present invention is DMAc.

The solution is extruded through a spinnerette (which may be of conventional design) into a coagulating bath. For DMAc solvent wet spinning the coagulating or spin bath is maintained at a temperature of from 0–600°C., preferably 10–50° C., and more preferably 20–40°C. Generally, the spin bath contains 10 to 70 wt. %, preferably 15 to 65 wt. %, and more preferably 20 to 60 wt. % of solvent by weight of the spin bath. In these ranges, all the water is associated with the solvent and the system behaves as a single phase coagulant which provides slower diffusion of solvent out of the coagulating fiber. The polymer composition and solvent concentration in the coagulation bath are correlated such that fiber density is at least 0.60, preferably at least 0.8 and most preferably 1.0 or higher. As referred to herein, the terms fiber and filament are utilized interchangeably.

The spun filaments may be subjected to jet stretch. Jet stretch, which is the speed of the first stretching roll set contacted by the filaments on exiting the spinnerette divided by the velocity of the polymer solution through the spinnerette, is controlled between 0.2 and 1.0, preferably 0.4 to 0.6. At lower jet stretch, processing difficulties are encountered and at higher jet stretch, void sizes tend to increase.

Subsequently, the filaments may be subjected to wet stretch. Wet stretch between 2X and 8X is provided by feeding the filaments into a second higher speed roll set and stretching the wet filaments. At lower wet stretch, low fiber strength results and higher stretch tends to open voids created in the spin bath. Wet stretch of from 3 to 6X is preferred. The temperature employed in the wet stretch process may range between the glass transition temperature, but less than the melting temperature of the polymer.

The fibers produced by the above described process may be treated by "in-line relaxation" or batch annealing prior to final use. In-line relaxation is achieved by feeding the filaments into a hot water bath, usually 800° C. to boiling and withdrawing the filaments at a slower speed to compensate for shrinkage which takes place in the bath. The relaxed filaments are dried by conventional heated rolls or heated air and are suited for use as is or after being converted to staple without the need for a batch annealing process. The drying may be utilized to stretch the filaments via "plastic stretching" (stretching the filaments and applying heat to render the filaments pliable) even further up to 3X, preferably up to 2X, and more preferably up to 1.5X. The filaments may be subjected to multiple washing and drying steps.

If desired, the filaments produced by the process of this invention can be subjected to conventional batch annealing processes in which case it is possible to obtain properties superior to those of conventional process filaments which have been batch annealed.

In an embodiment of the present invention, the acrylic fiber polymer precursor comprises acrylonitrile in an amount from greater than 90 to 98.0 wt. %; neutral vinyl monomer in an amount from greater than 0 to 7.0 wt. %; and optionally, ionic vinyl monomer in an amount from greater than 0 to 3.0 wt. % of the polymer at an amount dependent on the ionic monomer used.

In an embodiment of the present invention, the acrylic fiber comprises of an acrylic fiber polymer precursor having acrylonitrile in an amount from greater than 90 to 98.0 wt. %; neutral vinyl monomer in an amount from greater than 0 to 7.0 wt. %; and optionally, ionic vinyl monomer in an amount from greater than 0 to 3.0 wt. % of the polymer.

The polymeric materials of the acrylic fibers may be polyacrylonitrile copolymers, including binary and ternary polymers containing at least 90 wt. % of acrylonitrile in the polymer molecule; or a blend comprising polyacrylonitrile or copolymers comprising acrylonitrile with from 2 to 50 wt. % of another polymeric material, a blend having an overall polymerized acrylonitrile content of at least 80 wt. %.

In an embodiment of the present invention, neutral vinyl monomer, such as vinyl acetate, vinyl chloroacetate, vinyl proprionate, vinyl stearate, methyl acrylate, methyl methacrylate, etc., is also included in the polymeric materials in an amount greater than 0 to 7 wt. % of the polymeric material. Preferably, the neutral vinyl monomer is present in an amount from about 1 to about 6 wt. %, and more preferably from about 2.0 to about 5.5 wt. % of the polymeric material. The neutral vinyl monomer is preferably vinyl acetate.

Other monomers may be included in the acrylic fiber polymer precursor formulation. For example, such monomers include suitable monoolefinic monomers, including acrylic, alpha-chloro-acrylic and meta-acrylic acid; the acrylates, such as methylacrylate, methylmethacrylate, ethylmethacrylate, butylmethacrylate, methoxy methylmethacrylate, beta-chloroethylmethacrylate, and the corresponding esters of acrylic and alpha-chloro-acrylic acids; vinyl chloride, vinyl fluoride, vinyl bromide, vinylidene chloride, 1 -chloro-1-bromo-ethylene; methacrylonitrile; acrylamide and methacrylamide; alpha-chloroacrylamide; or monoalkyl substitution products thereof; methylvinyl ketone, N-vinylimides, such as N-vinylphthalimide and N-vinylsuccinimide; methylene malonic esters; and itaconic esters, N-vinylcarbazole, vinyl furane; alkyl vinyl esters; styrene, vinyl naphthalene, vinyl-substituted tertiary heterocyclic amines, such as the vinylpyridines and alkyl-substituted vinylpyridine, for example 2-vinylpyridine, 4-vinylpyridine, 2-methyl-5-vinylpyridine, etc.; 1-vinyl-imidazole and alkyl-substituted 1-vinylimidazoles such as 2-, 4-, and 5 methyl-1-vinylimidazole, and other vinyl containing polymerizable materials.

The acrylic fiber polymer precursor may be a ternary or higher interpolymer. For example, products obtained by the interpolymerization of acrylonitrile and two or more of any of the monomers, other than acrylonitrile, enumerated above may be utilized. More preferably, the ternary polymer comprises acrylonitrile, vinyl acetate, and itaconic acid. The ternary polymer may contain from 90 to 98 wt. % of acrylonitrile, 2 to 5 wt. % vinyl acetate, and from greater than 0 to 3 wt. % itaconic acid by weight of the polymer.

Ionic vinyl monomers of the present invention include itaconic acid, acrylic acid, methacrylic acid, vinyl sulfonic acid, sodium methallyl sulfonate, sodium styrene sulfonate, sodium p-sulfophenyl methallyl ether, sodium p-ethallyloxybenzensulfonate, sodium p-propallyloxybenzenesulfonate, acrylamido tertiary butyl sulfonic acid, sodium 2-methyl-2-acrylamido propane sulfonate, potassium p-ethallyloxybenzenesulfonate, lithium p-ethallyl-ozybenzenesulfonate, sodium p-methallyloxybenzenesulfonate, sodium 2-ethyl-4-ethallyloxybenzenesulfonate, sodium 2-propyl-4-methallyloxybenzenesulfonate, sodium-3-methyl-4-methallyloxybenzenesulfonate, potassium p-methallyloxybenzenesulfonate, potassium p-propallyloxybenzenesulfonate, potassium 2-ethyl-4-methallyloxbenzene sulfonate, ammonium p-methallyloxybenzenesulfonate, barium p-methallyloxybenzenesulfonate, magnesium p-methallyloxybenzenesulfonate, calcium p-methallyloxybenzenesulfonate, sodium m-methallyloxybenzenesulfonate, potassium m-methallyloxybenzenesulfonate, lithium m-methallyloxybenzenesulfonate, magnesium m-methallyloxybenzenesulfonate, calcium m-methallyloxybenzenesulfonate, barium m-methallyloxybenzenesulfonate, sodium o-methallyloxybenzenesulfonate, potassium o-methallyloxybenzenesulfonate, magnesium o-methallyloxybenzenesulfonate, ammonium o-methallyloxybenzenesulfonate, sodium 2-methyl-4-methallyloxybenzenesulfonate, sodium 2-methyl-3-methallyloxybenzenesulfonate, sodium 4-methyl-3-methallyloxybenzenesulfonate, sodium 5-methyl - 3 - methallyloxybenzenesulfonate, sodium 2-methyl-5-methallyloxybenzenesulfonate, sodium 5-methyl-2-methallyloxybenzenesulfonate, sodium 5-methyl-2-methallyloxybenzenesulfonate, sodium 6-methyl-2-methallyloxbenzenesulfonate and the like. Preferably, the ionic vinyl monomer of the present invention is sodium p-sulfophenyl methallyl ether. Generally, the ionic vinyl monomer is present in the acrylic fiber polymer precursor in an amount greater than 0 to 5.0 wt. %, preferably from 0.1 to 4 wt. %, and more preferably 0.2 to 3 wt. % of the polymer.

In another embodiment of the present invention, the acrylic fiber polymer precursor comprises 90.0 to 98.0 wt. % acrylonitrile, from about 2 to 5 wt. % vinyl acetate, greater than 0 to 3.0 wt. % itaconic acid and/or greater than 0 to 1.0 wt. % p-sulfophenyl methallyl ether by weight of the polymer.

The acrylic fiber polymer precursor, fiber and processes for making thereof are further defined by reference to the following illustrative examples.

EXAMPLE 1

An acrylic fiber polymer precursor is prepared by continuous aqueous dispersion redox polymerization as follows. A 3.5 liter continuously stirred tank reactor is held at a temperature of 50° C. The average residence time of the reactants is 60 minutes. The composition of the total feed is:

| Compound | Quantity | Units |
|---|---|---|
| Acrylonitrile monomer | 91.00 | parts |
| Vinyl acetate monomer | 9.00 | parts |
| Water | 250.0 | parts |
| Ammonium persulfate (initiator) | 0.28 wt. % based on monomer | |
| Sulfur dioxide (activator) | 0.924 wt. % based on monomer | |
| Iron (Ferrous or Ferric) | 1.6 ppm based on monomer | |
| Sulfuric acid | trace | |

The acrylic fiber is then prepared by the following process.

A 24.6 wt. % solution of copolymer and 1.1 wt. % pigment in a solvent consisting of 99.9 wt. % dimethylacetamide and 0.1 wt. % water is prepared at 90° C. The copolymer contains 7.4 wt. % vinyl acetate and 92.6 wt. % acrylonitrile.

The solution is extruded through a spinneret into a coagulant bath containing 54 wt. % dimethylacetamide, 46 wt. % water mixture which is maintained at 300° C.

The fibers formed are withdrawn from the coagulation bath by passage through a first roll set to give a jet stretch ratio of 0.76 and are passed through water at 980° C. into a second roll set to provide a wet stretch of 6X.

A water emulsion of finish is circulated through the fiber bundle at 980° C. and the fibers dried by passage over a hot roll. The fibers produced are 2.16 denier per filament. The fibers are annealed in a batch process by exposure to steam for 20 minutes. The annealed fiber denier is then 2.65 denier per filament.

Yarn samples obtained from the fiber are subjected to testing for evaluation of hot-wet properties at 70° C. reveal 11.1 wt. % singles hot-wet yarn elongation and 10.7 wt. % plied hot-wet yarn elongation.

EXAMPLES 2–8

The remaining acrylic fiber polymer precursors and fibers (Example 2–8) made therefrom are made by the above-mentioned processes except that the amounts of the monomers utilized may change.

The yarn samples obtained from the above Examples are then subjected to testing for evaluation of hot-wet properties. Each yarn is placed in a bath of distilled water maintained at 70° C. having a 313 g weight attached to one end and the other end attached to an adjustable sample hook. The yarn is submerged for an hour, removed from the water and the length of yarn stretching is measured. From this length, the percent elongation of the yarn may be calculated by the following formula:

$$\% \text{ Elongation} = \frac{\text{Final Yarn Length} - \text{Initial Yarn Length}}{\text{Initial Yarn Length}} \times 100$$

The hot-wet properties of the acrylic fibers are set forth in Table 1 below.

TABLE 1

| Example: | 1 | 2 | 3 | 4 | 5 | 6 | 7 | 8 |
|---|---|---|---|---|---|---|---|---|
| Comonomer, % VA | 7.40 | 6.00 | 4.80 | 4.15 | 4.75 | 4.70 | 3.26 | 1.98 |
| Comonomer, % SPME | None | 0.60 | None | None | 0.30 | 0.60 | None | None |
| Comonomer, % IA | None | None | None | None | None | None | 2.23 | 2.32 |
| Single Filament: | | | | | | | | |
| Denier | 2.65 | 2.61 | 2.75 | 2.66 | 2.64 | 2.86 | 2.54 | 2.69 |
| Hot-Wet Properties: Surrogate Yarn Tests: | | | | | | | | |
| Singles Elongation, % | 11.1 | 6.9 | 5.3 | 3.4 | 5.7 | 6.9 | 6.9 | 6.1 |
| Plied Elongation, % | 10.7 | 6.9 | 5.3 | 3.1 | 5.7 | 6.9 | 7.3 | 5.7 |

The results set forth in Table 1 demonstrate that the use of vinyl acetate in amounts less than 7 wt. % of the acrylic fiber polymer precursor impart the resulting acrylic fiber with exceptional hot-wet properties. The elongation of the acrylic fiber is generally less than 9%, preferably less than 7%, and more preferably less than 6%.

What is claimed is:

1. An acrylic fiber comprising an acrylic polymer that comprises, an acrylic monomer having acrylonitrile in an amount from 90 to 98.0 wt. % of said fiber; and neutral vinyl monomer in an amount from greater than 1 to 6.0 wt. % of said fiber, wherein yarn prepared from said fiber possesses hot-wet elongation less than 7% at 70° C.

2. An acrylic fiber according to claim 1, wherein said fiber comprises ionic vinyl monomer in an amount from greater than 0 to 3.0 wt. % of said fiber.

3. An acrylic fiber according to claim 1, wherein said neutral vinyl monomer comprises vinyl acetate, vinyl chloroacetate, vinyl propionate, vinyl stearate, vinylidene chloride, methyl acrylate, or methyl methacrylate.

4. An acrylic fiber according to claim 1, wherein said neutral vinyl monomer comprises vinyl acetate.

5. An acrylic fiber according to claim 2, wherein said ionic vinyl monomer is sodium p-sulfophenyl methallyl ether present in said polymer in an amount of greater than 0 to 1.0 wt. % of said polymer.

6. An acrylic fiber according to claim 1, wherein said acrylonitrile is present in amount from 94.0 to 98.0 wt. %, and said neutral vinyl monomer is present in an amount from 1.0 to 6.0 wt. % of said polymer.

7. An acrylic fiber according to claim 2, wherein said ionic vinyl monomer is present in an amount from 0.2 to 2.5 wt. % of said polymer.

8. An acrylic fiber according to claim 1, wherein said ionic vinyl monomer is itaconic acid present in said polymer in an amount of greater than 0 to 3.0 wt. % of said polymer.

9. An acrylic fiber according to claim 1, wherein said fiber comprises a blend of acrylic polymers.

10. An acrylic fiber according to claim 1, herein said fiber possesses hot-wet elongation less than 6% at 70° C.

11. An acrylic fiber comprising an acrylic polymer that comprises, an acrylic monomer having acrylonitrile in an amount from 94 to 98.0 wt. % of said fiber; and neutral vinyl monomer in an amount from greater than 1 to 6.0 wt. % of said fiber, wherein yarn prepared from said fiber possesses hot-wet elongation less than 7% at 70° C.

12. An acrylic fiber according to claim 11, wherein said neutral vinyl monomer is present in an amount from 2–5.5 wt. % of said fiber.

13. An acrylic fiber according to claim 11, wherein said said fiber comprises ionic vinyl monomer in an amount from greater than 0–3.0 wt. % of said fiber.

14. An acrylic fiber according to claim 13 wherein the sum of the neutral vinyl monomer and the ionic vinyl monomer is less than about 6% of said fiber.

* * * * *

UNITED STATES PATENT AND TRADEMARK OFFICE

CERTIFICATE OF CORRECTION

PATENT NO. : 6,268,450 B1
DATED : July 31, 2001
INVENTOR(S) : Bruce E. Wade

It is certified that error appears in the above-identified patent and that said Letters Patent is hereby corrected as shown below:

Column 3,
Line 12, delete "0-600" and insert -- 0-60 --;
Line 43, delete "800" and insert -- 80 --;

Column 5,
Line 67, delete "300" and insert -- 30 --;

Column 6,
Line 3, delete "980" and insert -- 98 --
Line 7, delete "980" and insert -- 98 --

Column 8, claim 10,
Line 7, delete "herein" and insert -- wherein --

Signed and Sealed this

Twenty-sixth Day of February, 2002

*Attest:*

*Attesting Officer*

JAMES E. ROGAN
*Director of the United States Patent and Trademark Office*